United States Patent [19]

Jefferson

[11] 4,354,540

[45] Oct. 19, 1982

[54] SCREW HOLDER SYSTEM

[76] Inventor: Robert T. Jefferson, 4604 Luerssen Ave., Baltimore, Md. 21206

[21] Appl. No.: 185,219

[22] Filed: Sep. 8, 1980

[51] Int. Cl.[3] ..... B25C 3/00

[52] U.S. Cl. ..... 145/46

[58] Field of Search ..... 145/46

[56] References Cited

U.S. PATENT DOCUMENTS

| | | | |
|---|---|---|---|
| 337,061 | 3/1886 | Higgins et al. . | |
| 924,054 | 6/1909 | Gehne | 145/46 |
| 1,127,838 | 2/1915 | Willers | 145/46 |
| 2,953,049 | 9/1960 | Vilmerding . | |
| 2,985,208 | 5/1961 | Hibbard et al. . | |
| 3,357,617 | 12/1967 | Osborne . | |
| 3,381,551 | 5/1968 | Lavering et al. | 145/46 |
| 3,860,161 | 1/1975 | Engstrom et al. . | |
| 4,079,765 | 3/1978 | Hatayan | 145/46 |
| 4,139,036 | 2/1979 | Regan et al. | 145/46 |

FOREIGN PATENT DOCUMENTS

| | | | |
|---|---|---|---|
| 390385 | 2/1924 | Fed. Rep. of Germany | 145/46 |
| 1088438 | 9/1960 | Fed. Rep. of Germany | 145/46 |
| 397728 | 5/1909 | France | 145/46 |
| 1020706 | 2/1953 | France | 145/46 |
| 1202767 | 7/1959 | France | 145/46 |
| 1405902 | 6/1965 | France . | |
| 846337 | 8/1960 | United Kingdom | 145/46 |
| 1506398 | 4/1978 | United Kingdom . | |
| 1507022 | 4/1978 | United Kingdom . | |

*Primary Examiner*—Stephen G. Kunin
*Assistant Examiner*—J. T. Zatarga
*Attorney, Agent, or Firm*—John F. McClellan, Sr.

[57] ABSTRACT

A screw holder system for manually positioning screws for driving provides a finger-protecting spool-shaped body with coaxial bore having closer to the bottom end than to the top a screw-centering, resilient biasing apparatus; similar bottom-plan and top-plan aspects suit the system for inverted use to hold longer screws; a bushing held by the biasing apparatus adapts the system for holding a different range of screws, with smaller head diameter; a self-levelling device is provided for use either-end-up; an axial extender provision adapts the system for use with longer screws or alternatively with greater screwdriven overlap.

7 Claims, 8 Drawing Figures

SCREW HOLDER SYSTEM

FIELD OF THE INVENTION

This invention relates generally to driving fasteners and specifically to a system for positioning and holding and driving elongate fasteners such as screws and the like.

BACKGROUND OF THE INVENTION

In the prior art numerous disclosures relating to the field of the invention have been made including three of the following patents:

U.S. Pat. No. 337,061 to O. Higgins and A. S. Condet, Mar. 2, 1886 discloses a holder in which a headless tack is retained by a spring;

U.S. Pat. No. 2,953,049 to J. B. Vilmerding, Sept. 20, 1960, discloses holding work by ball plungers in position for engagement by a driving action; this represents several similar disclosures;

U.S. Pat. No. 2,985,208 to R. G. Hibbard and F. B. Berry, Mar. 23, 1961, discloses a manual screw-holder;

U.S. Pat. No. 3,357,617 issued to W. E. Osborne, Dec. 12, 1967, and 3,860,161 are cited as having power tool type retention of fasteners, at least one with three-ball to hold fasteners;

U.S. Pat. No. 4,139,036 to J. R. and R. R. Regan, Feb. 13, 1979, discloses screw-holding by means of a topless and bottomless body having a perforate web at an intermediate portion thereof;

British Pat. No. 1,506,398 issued to B. E. Viner on Apr. 5, 1978 discloses screw-retaining balls held by a resilient rubber sleeve;

British Pat. No. 1,507,022 issued to G. Wilson on Apr. 12, 1978 discloses a split-end screw holder with a reduced-diameter middle portion;

French Pat. No. 1,405,902 discloses a double-ended fastener holder which evidently could be used equally well either-side-down.

However, none of the known instruments of the type described discloses the advantages combination of the present invention according to the objects herein, which include:

- to provide an improved system for holding screws for driving, which produces a superior result with any type or composition of surface, while increasing safety, as compared with other systems for manually positioning screws;
- to provide a system as described which has self-levelling, non-skid characteristics, even on uneven surfaces, and which offers plural modes for screw holding and driving;
- to provide a system as described which automatically centers in it screws held, regardless of size within a range of sizes, which has adapter provision to change ranges of screw sizes and screwdriver sizes, which protects the surface receiving the screw from accidental damage from screwdriver and screw;
- to provide a system as described which is easy to load, easy to use and to learn to use, which is light in weight and easily manipulated, and provides a sure, protective manual grip;
- to provide a system as described with structure to help center the system on the desired spot for driving a screw, both visually and tactilely;
- to provide a system as described which is adaptable for manufacturing in any of a variety of materials, which is economical to produce, is durable, reliable and attractive in appearance.

BRIEF SUMMARY

In brief summary given for cursive descriptive purposes only and not as limitation, the invention includes a manually manipulatable sleevelike body contoured for holding and having a central bore system adapted for receiving and holding a screw of any of a wide range of sizes and lengths centrally over a desired point on a surface, even or uneven, for driving the screw into the surface at that point.

The above and other objects and advantages of this invention will become more readily apparent on examination of the following description, including the drawing Figures, in which like characters refer to like parts:

DETAILED DESCRIPTION OF THE DRAWINGS

Figure 1:
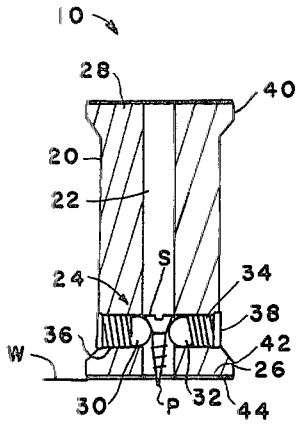
FIG. 1 is a side elevational view, partly in section, of a basic embodiment of the invention in use holding a screw.

FIG. 1 shows the invention in embodiment 10 as comprising a screw holding and centering system for manual positioning of a screw for driving; it includes a cylindrical body 20 with a coaxial screw-guiding bore 22 through it and a screw S held in the bore in coaxial position for driving by a screw-driver from above. Screw-centering means 24 is closer to the axis-perpendicular bottom surface 26 than the top surface 28 which is parallel-spaced from the bottom surface.

The screw-centering means resiliently biases each screw held, towards the bore axis; it may comprise a trio of steel balls 30, 32, shown, spaced 120° apart in a plane perpendicular to the bore, each ball being urged against the others by a coil expansion spring 34 held in a radial passage 36 closed at the outer end by a cap 38 threaded into or otherwise affixed in a respective passage.

In operation, a screwdriver is thrust down from the top to engage the screw; it can pass through the centering means while driving.

Finger-protection means comprises a first circumferential flange 40 having a portion co-planar with the top surface of the body and a second, similar flange 42 having a portion co-planar with the bottom surface of the body, like the flanges on a spool. These flanges increase the contact area with a working surface W and further stabilize the body, regardless of which end is up, in addition to providing protection for fingers from misdirected screwdriver blades and from slippage of the body on rough or sharp surfaces. In addition they provide an important improvement in manual gripping, enabling the user to exert pressure against a work surface more easily and securely.

To further the slip-protection provision a rubber-cement or other non-skid material 44 may be provided on the top and bottom surfaces. This can also prevent marring of delicate finishes on work surfaces.

Figure 2:
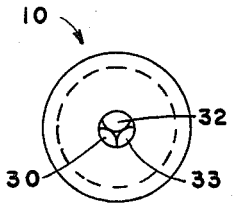
FIG. 2 is an axial view of the FIG. 1 embodiment.

FIG. 2 shows the plan view of embodiment 10, and the centered, normally contacting, relation of the balls 30, 32, 33.

Figure 3:
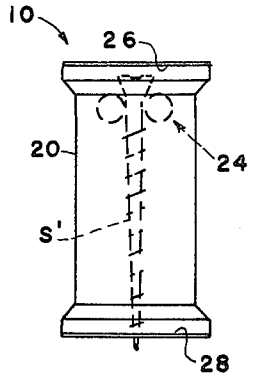
FIG. 3 is a side elevational view of the FIG. 1 embodiment inverted and holding a long screw.

FIG. 3 shows the embodiment 10 inverted to hold a long screw S', as when the hole for it has already been started. Similar upright and inverted plan dispositions of the body 20, and of centering means 24 which is closer to the "bottom surface" when upright, make this possible.

Figure 4:
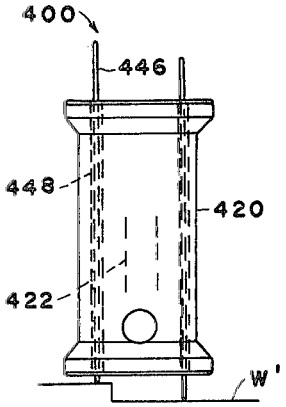
FIG. 4 is an elevational view of a second embodiment showing a first levelling provision.

FIG. 4 shows in preferred mode self-levelling embodiment 400 like the previous embodiment except that a plurality of elongate members 446 can adjustably extend from respective holes 448 through the body 420, substantially parallel with the bore 422, to accommodate bearing of the body to rough or uneven surfaces, W' shown.

Each elongate member can be a rod of plastic (Nylon or other) or plastic-covered metal, frictionally held in a respective hole, and pressed (or tapped) through to desired extension to establish level regardless of which end of the body is up. The work surface can be used for pressing with the spool forced down in level attitude. Alternatively, the elongate members can be screw-thread connected in the body for rotational adjustment of extension from top or bottom.

Figure 5:
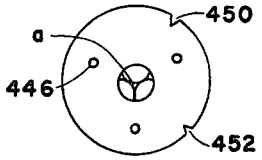
FIG. 5 is a plan view thereof.

FIG. 5 shows the plan view of the embodiment with the preferably three elongate members, 446 indicated, spaced preferably at 120° in a circle concentric with the bore axis a, and an additional visual-and-tactile centering provision for the body to guide the axis, and a coaxially held screw, over a desired cross-marked point in a work surface into which it is desired to drive a screw.

This body-centering structure may comprise first and second notches 450, 452 in a peripheral portion of the body adjacent the work surface. These notches may have a linear spacing apart equal to the distance to either one of them from the bore axis a so that the user can preliminarily set the distance from notch to intended screw driving point. The user measures the distance out from a point where the screw is to be centered and makes two marks on the work separated, for example, at 90°. The rim of the screw holder is then placed at these marks, centering the axis on the intended screw location. Alternatively the notches may lie at a predetermined relative angle (which may be 90°) centered on the bore axis a, so that a customary point cross-marking will match and indicate center location as a guide to the eye, or to feel, particularly if the usual cross-marked scratches are used.

Figure 6:
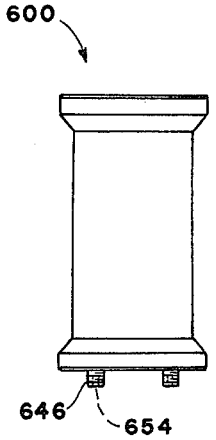
FIG. 6 is an elevational view of a further levelling provision in an embodiment.

FIG. 6 shows an embodiment 600 which is similar to the previous embodiment except that the self-levelling provision comprises a plurality of screws, 646 indicated, which preferably have either screwdriver slots or Allen screw sockets 654 for levelling adjustment; there may be only one set, but alternatively both top surface and bottom surface may have a set of three each, equally spaced circumferentially and radially.

Figure 7:
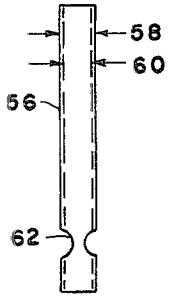
FIG. 7 is an elevational view of a reducing adapter comprising part of any embodiment.

FIG. 7 shows a screw-head range-changing provision, a bushing 56 with an outside diameter 58 proportioned for close sliding fit inside the body bore and an inside diameter 60 proportioned for guiding screw heads, and thus screw points, in a relatively smaller range of sizes.

To retain the bushing 56 in a bore of a body the lower end has a plurality of transverse apertures 62 in a plane, corresponding in location to the balls (or equivalent centering means protrusive into the bore). Through these apertures, which preferably are holes, the balls protrude, both to center the screw body and to retain the bushing.

Figure 8:
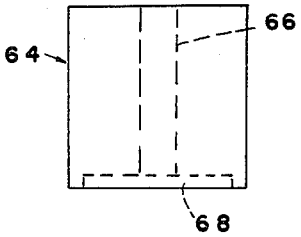
FIG. 8 is a view of an adapter comprising part of any embodiment, in side elevation.

FIG. 8 shows a longitudinal body extender 64 which has an axial hole 66 through it and a recess 68 for fitting over the body (or equivalent means) at the bottom for co-axially securing it to either end of the spool, as by friction fit. This provision permits handling longer screws, as when inverted, and alternatively provides for longer and safer screwdriver overlap which can be particularly useful with push-type or ratchet screwdrivers, which are dangerous.

Material for the body, bushing, and body extender may be any suitable material such as steel, brass, or a tough plastic such as "Nylon or preferably transparent polystyrene. Even very hard hardwood such as maple may serve.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a system for screw holding comprising a body with a bore axially therethrough and means in the bore for resiliently holding a screw centered for driving into a work surface, the improvement comprising in combination: reversible means to accommodate both relatively long and relatively short screws including: the body having a top surface and a bottom surface in parallel spacing transverse to the bore, the screw holding means being substantially the same in construction, top and bottom; the screw centering means being closer to the bottom surface than to the top surface and protruding generally perpendicularly into the bore from the body, the body having cylindrical shape with the bore axial therein, means for protecting fingers of a user holding the body, comprising first and second spool-like flanges circumferentially around respective ends of the body, means increasing the work surface contacting area of the body, comprising the first flange having a portion co-planar with the top of the body and the second flange having a surface co-planar with the bottom of the body, and the bore being a uniform cylindrical bore through said body and proportioned for fitting and guiding the heads of screws passed through the bore.

2. In a system for screw holding comprising a body with a bore axially therethrough and means in the bore for resiliently holding a screw centered for driving into a work surface, the improvement comprising in combination: reversible means to accommodate both relatively long and relatively short screws including: the body having a top surface and a bottom surface in parallel spacing transverse to the bore, the screw holding means being substantially the same in construction, top and bottom; the screw centering means being closer to the bottom surface than to the top surface and protruding generally perpendicularly into the bore from the body, the bore diameter uniform and proportioned for fitting and guiding the heads of screws in a first range of sizes, means for changing said range of sizes, comprising a bushing having outer diameter fitting said bore diameter for insertion therein and having inner diameter proportioned for guiding heads of screws in a second range of sizes, and the sleeve having retention means including an aperture portion for protrusion therethrough of said means for resiliently holding.

3. In a system as recited in claim 2, the aperture portion including a plurality of holes transversely through the bushing.

4. In a system for screw holding comprising a body with a bore axially therethrough and means in the bore for resiliently holding a screw centered for driving into a work surface, the improvement comprising in combination: reversible means to accommodate both relatively long and relatively short screws including: the body having a top surface and a bottom surface in parallel spacing transverse to the bore, the screw holding means being substantially the same in construction, top and bottom; the screw centering means being closer to the bottom surface than to the top surface and protruding generally perpendicularly into the bore from the body, and means adjustably extensible from the body for levelling said system on an uneven work surface.

5. In a system as recited in claim 4, the adjustably extensible means including a plurality of elongate members extensible from the body generally parallel with said bore.

6. In a system as recited in claim 5, means providing for extension of said elongate members selectively from said top surface or said bottom surface as desired by the user, comprising said plurality of elongate members held in a respective plurality of holes through the body for passage therethrough in either direction.

7. In a system as recited in claim 5, at least one of said elongate members adjustable extension being by means of a screwthread connection in the body.

* * * * *